US009995552B2

(12) United States Patent
Cuddeback

(10) Patent No.: US 9,995,552 B2
(45) **Date of Patent: *Jun. 12, 2018**

(54) RETRACTABLE GUN STAND

(71) Applicant: cFish, LLC, De Pere, WI (US)

(72) Inventor: Mark J. Cuddeback, Green Bay, WI (US)

(73) Assignee: cFish, LLC, De Pere, WI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/673,918

(22) Filed: Aug. 10, 2017

(65) Prior Publication Data

US 2017/0370670 A1 Dec. 28, 2017

Related U.S. Application Data

(63) Continuation-in-part of application No. 15/225,194, filed on Aug. 1, 2016, now Pat. No. 9,816,774, which (Continued)

(51) Int. Cl.
*F41A 23/06* (2006.01)
*E04H 12/18* (2006.01)

(52) U.S. Cl.
CPC ..... *F41A 23/06* (2013.01); *E04H 12/185* (2013.01)

(58) Field of Classification Search
CPC ..... F41A 23/06; E04H 12/185
See application file for complete search history.

(56) References Cited

U.S. PATENT DOCUMENTS 1,147,890 A 7/1915 Purcell
2,799,368 A 7/1957 Alter
(Continued)

FOREIGN PATENT DOCUMENTS

CN 1051955 A 6/1991
CN 201396565 Y 2/2010
(Continued)

OTHER PUBLICATIONS

"Gun Stand", Carroll Design brochure, Jan. 10, 2013, 8 pages, Cuddeback Digital.

(Continued)

*Primary Examiner* — Reginald Tillman, Jr.
(74) *Attorney, Agent, or Firm* — Michael Best & Friedrich LLP

(57) ABSTRACT

A retractable stand comprises a base, two ribbons, and a locking mechanism. Each ribbon has a coiled portion and an uncoiled portion. The uncoiled portions have a curved cross-sectional shape positioned in opposing relation to each other. The locking mechanism is movable between an unlocked position and a locked position where the at least one ribbon is substantially inhibited from moving relative to the base in at least one direction. The locking mechanism can comprise an auto-locking member biased toward the locked position. The locking mechanism can further comprise a trigger mounted on the base and accessible by the user to move the auto-locking member to the unlocked position. Preferably, the retractable stand further includes a manual locking mechanism that can be manually selectively moved between unlocked and locked positions to selectively lock and unlock a position of at least one of the ribbons relative to the base.

20 Claims, 16 Drawing Sheets

Related U.S. Application Data is a continuation of application No. 13/827,956, filed on Mar. 14, 2013, now Pat. No. 9,423,199.

(56) References Cited

U.S. PATENT DOCUMENTS

| | | | | |
|---|---|---|---|---|
| 2,956,795 | A | | 10/1960 | Foster |
| 3,016,988 | A | | 1/1962 | Browning |
| 3,242,576 | A | | 3/1966 | Wheeler |
| 3,363,891 | A | * | 1/1968 | Foster ..... F03G 1/00 185/37 |
| 3,583,322 | A | | 6/1971 | Vykukal |
| 3,625,563 | A | | 12/1971 | Dickinson et al. |
| 3,666,220 | A | | 5/1972 | Rider |
| 3,822,874 | A | | 7/1974 | Snyder et al. |
| 3,860,041 | A | | 1/1975 | Leiter |
| 3,870,263 | A | | 3/1975 | Hardiman et al. |
| 3,890,907 | A | | 6/1975 | Peterson |
| 4,135,626 | A | | 1/1979 | Cawood |
| 4,553,726 | A | | 11/1985 | Jackson |
| 4,601,246 | A | | 7/1986 | Damico |
| 4,616,218 | A | | 10/1986 | Bailey et al. |
| 4,807,836 | A | | 2/1989 | Price et al. |
| 4,922,836 | A | | 5/1990 | Damico |
| 5,056,278 | A | | 10/1991 | Atsukawa |
| 5,081,782 | A | | 1/1992 | Wright |
| 5,221,009 | A | | 6/1993 | Ritzenthaler |
| 5,507,111 | A | | 4/1996 | Stinson et al. |
| 5,549,264 | A | * | 8/1996 | West ..... F16M 11/08 248/157 |
| 5,842,284 | A | | 12/1998 | Goldman |
| 6,249,986 | B1 | | 6/2001 | Murray |
| 7,380,486 | B1 | | 6/2008 | Bean |
| 7,500,328 | B1 | | 3/2009 | Bean |
| 7,954,271 | B1 | | 6/2011 | Bentley et al. |
| 8,016,350 | B2 | | 9/2011 | Dellanno |
| 8,104,313 | B2 | | 1/2012 | Wolfe |
| 2009/0039211 | A1 | | 2/2009 | Hsu |
| 2011/0012003 | A1 | | 1/2011 | Woodruff et al. |
| 2011/0024596 | A1 | | 2/2011 | Kephart |
| 2011/0265367 | A1 | | 11/2011 | Saunders, III |

FOREIGN PATENT DOCUMENTS

| | | | |
|---|---|---|---|
| CN | 201716514 | U | 1/2011 |
| CN | 203275862 | U | 11/2013 |
| GB | 2136081 | A | 9/1984 |
| WO | 2007053694 | A2 | 5/2007 |
| WO | 2007053694 | A3 | 7/2007 |

OTHER PUBLICATIONS

First Office Action with English translation from the State Intellectual Property Office of the People's Republic of China for Application No. 201410557667.1 dated Dec. 21, 2017 (17 pages).

* cited by examiner

RETRACTABLE GUN STAND

RELATED APPLICATIONS

This application is a continuation in part of U.S. patent application Ser. No. 15/225,194, filed Aug. 1, 2016, which is a continuation of U.S. patent application Ser. No. 13/827,956, filed Mar. 14, 2013, now U.S. Pat. No. 9,423,199. The entire contents of the above-listed applications are incorporated herein by reference.

BACKGROUND

The present invention relates generally to gun accessories and specifically to supports on which guns can be rested while shooting.

In order to increase the accuracy of aiming a gun, the gun can be rested upon a gun stand, often called a shooting stick. Gun stands come in a variety of different styles, such as a tripod, bipod, or monopod. Gun stands can be structurally separate from the gun or they can be attached (e.g., hinged) to the gun in a retracted or stored position to facilitate quick deployment of the gun stand.

SUMMARY

The present invention provides a retractable stand comprising a base adapted to support a device, two ribbons, and a locking mechanism (e.g., a cam lock actuator) mounted on the base. Each ribbon has a coiled portion and an uncoiled portion, and the uncoiled portions of the ribbons have a curved cross-sectional shape and are positioned in opposing relation to each other. The locking mechanism is movable between an unlocked position where at least one ribbon is substantially permitted to move relative to the base and a locked position where the at least one ribbon is substantially inhibited from moving relative to the base in at least one direction. For example, the locked position may substantially inhibit movement of the at least ribbon into the base but does not substantially inhibit movement of the at least one ribbon out of the base.

The base can comprise a housing that substantially entirely encloses the coiled portions of the two ribbons. Preferably, the curved cross-sectional shape of each uncoiled portion defines a convex surface and a concave surface, and the convex surfaces of the uncoiled portions of the ribbons are in facing relation to each other.

In one embodiment, the locking mechanism comprises a biased locking mechanism having an auto-locking member biased toward the locked position. The locking mechanism can further comprise a trigger mounted on the base and accessible by the user to move the auto-locking member to the unlocked position. Preferably, the retractable stand further includes a manual locking mechanism that can be manually selectively moved between unlocked and locked positions to selectively lock and unlock a position of at least one of the ribbons relative to the base. The manual locking mechanism can include at least two manual locking members, both of which are biased toward an unlocked position.

The present invention is also embodied in a method of using a retractable stand having a base, two ribbons and a locking mechanism mounted on the base. The method comprises moving a free end of the uncoiled portions of the ribbons away from the base to thereby uncoil a portion of the ribbons, supporting the free end on a supporting surface below the base, substantially inhibiting movement of the free end toward the base using the locking mechanism, holding the base above the supporting surface, and positioning a device on the base. The device can include a variety of useful objects, such as a rifle, a pistol, a still camera, a video camera, or a cross bow.

The free end can include a foot brace, and the step of moving the free end can include placing a user's foot on the foot brace. The locking mechanism can include a cam lock actuator, and the step of substantially inhibiting can include moving the cam lock actuator from an unlocked position to a locked position. Preferably, the step of substantially inhibiting includes substantially permitting movement of the free end away from the base.

In one embodiment, the method further comprises retracting the free end toward the base until the uncoiled portions of the ribbons are completely housed within the base. In an embodiment where the locking mechanism includes an auto-locking member biased toward a locked position and a trigger mounted on the base and accessible by the user to move the locking member from the locked position to an unlocked position, the step of retracting can comprise moving the trigger. The retractable stand can further include a manual locking mechanism that is manually movable between unlocked and locked positions to selectively lock and unlock a position of at least one of the ribbons relative to the base. In this version of the invention, the method can further include, after the moving step and before the retracting step, the step of manually moving the manual locking mechanism to the locked position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
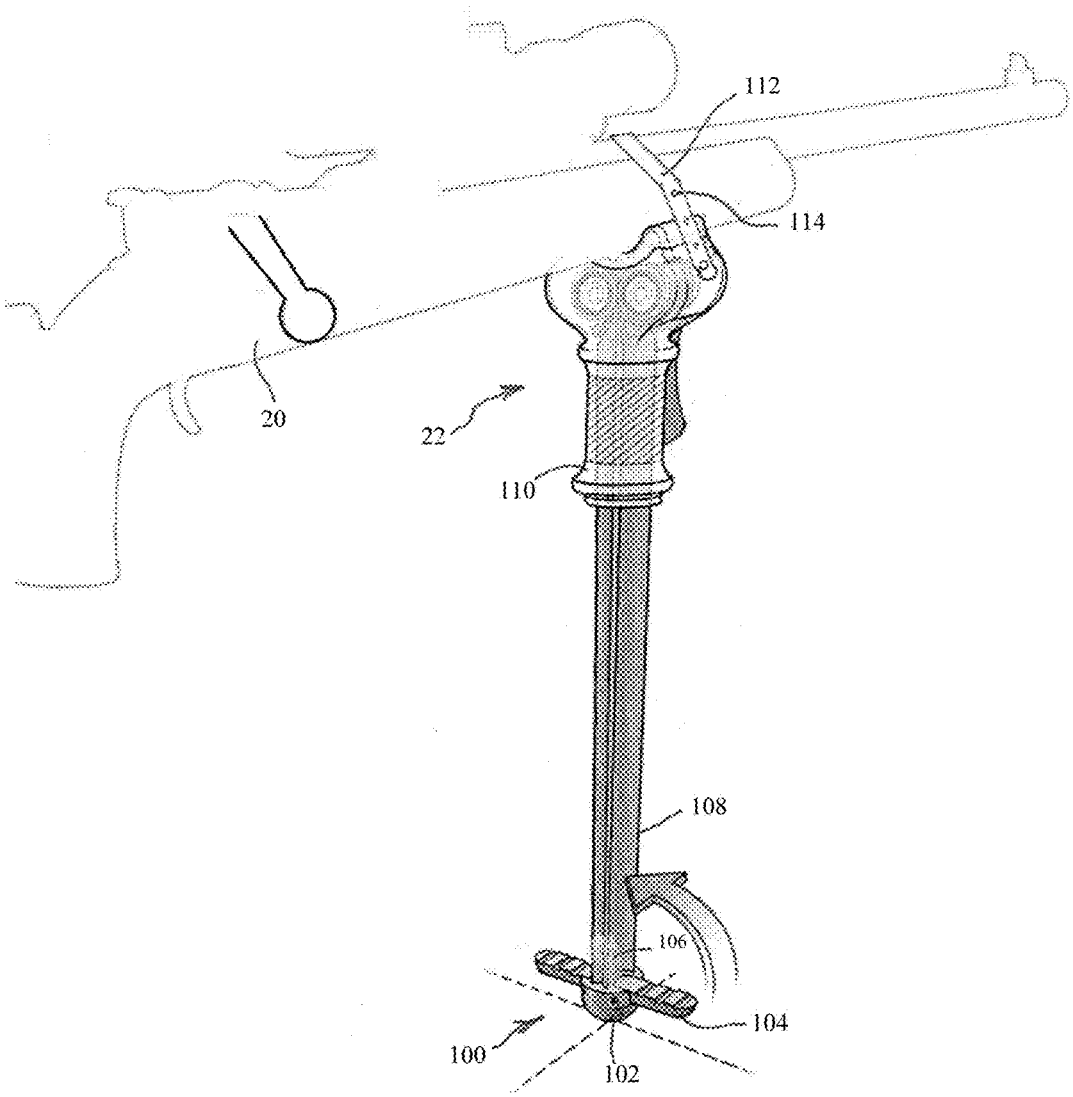
FIG. 1 illustrates a gun being supported by a retractable gun stand embodying the present invention.
Figure 2:
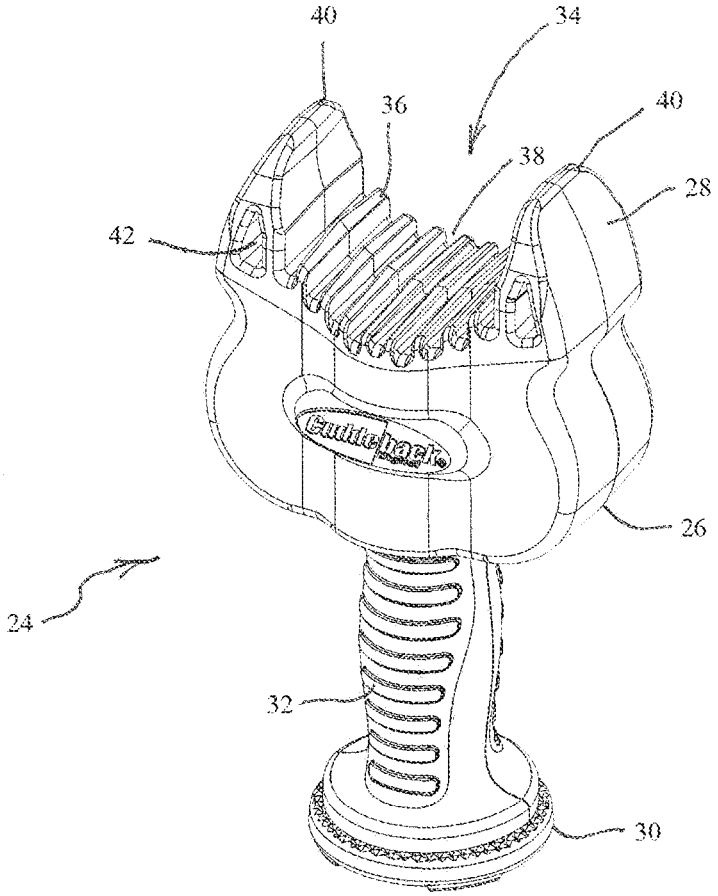
FIG. 2 is a perspective view of a second embodiment of the retractable gun stand.
Figure 3:
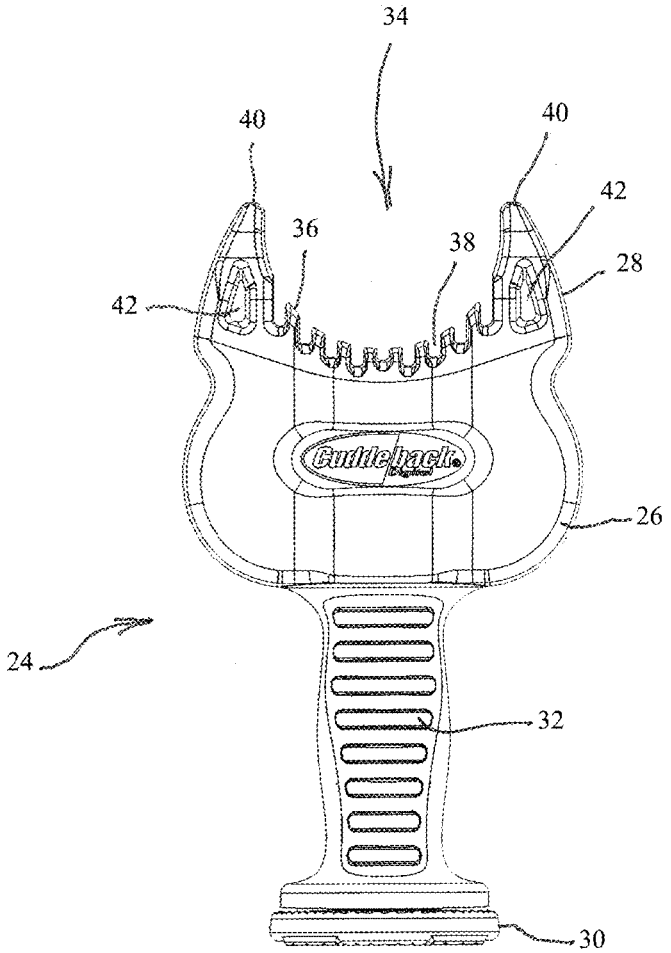
FIG. 3 is a front view of the gun stand illustrated in FIG. 2 with a foot brace in a retracted position.

FIG. 1 illustrates a gun 20 being supported by a gun stand 22 to thereby create a gun and gun stand assembly. The gun 20 can be any of numerous different types of guns, such as a rifle or a handgun.

A different gun stand 24 is illustrated in more detail in FIGS. 2-11. The illustrated gun stand 24 includes a housing 26 (including a front portion 26*a* and a rear portion 26*b*), an upper support 28, and a foot brace 30. The housing 26 includes a grip portion 32 and defines an enclosure for housing the movable components of the gun stand 24. The illustrated housing 26 is made from a rigid plastic material, although other materials could be used. If desired, the housing 26 can be formed as a single part.

The upper support 28 is secured to the upper surface of the housing 26. The upper support 28 defines a concave cradle 34 and is made from a soft resilience material (more resilient than the housing) that enhances the frictional contact between the gun and the gun stand 24. The upper support 28 includes a plurality of longitudinal ribs 36 separated by channels 38, and further includes side supports 40 that limit lateral movement of the gun relative to the gun stand 24. Each side support 40 includes an opening 42 extending longitudinally through the side support 40 to reduce the weight of the gun stand 24 and also increase the resiliency of the side support 40.

Figure 4:
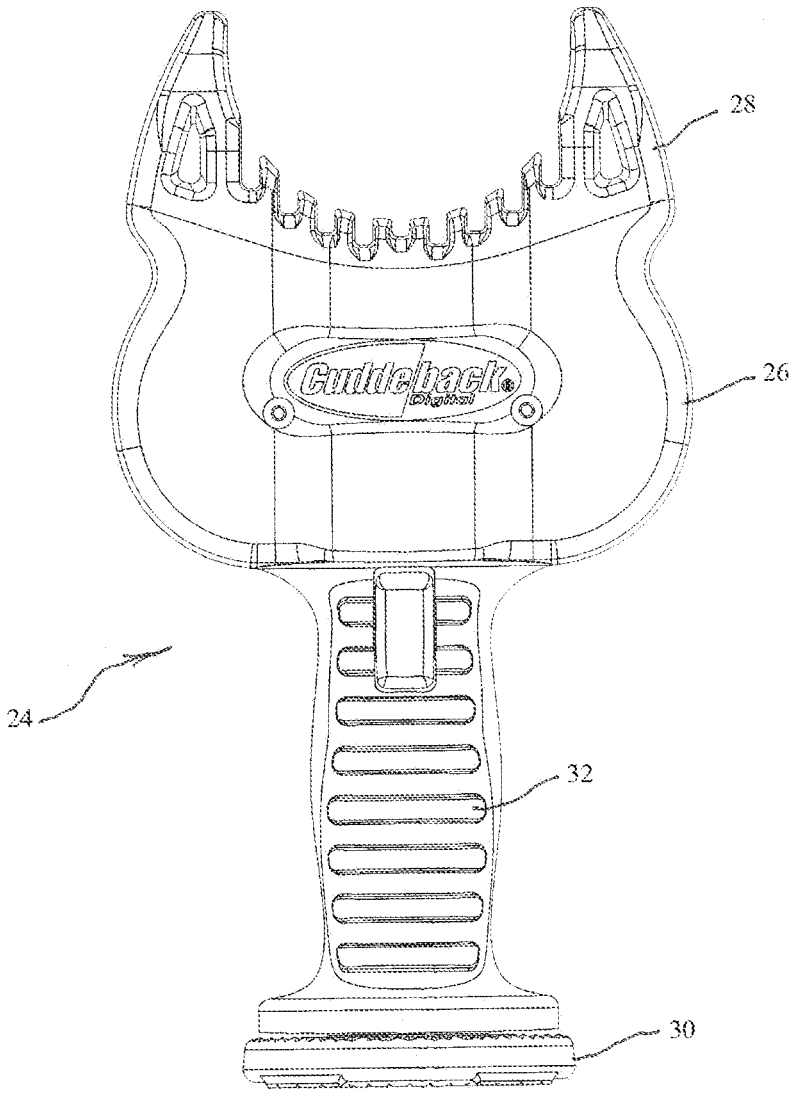
FIG. 4 is a rear view of the gun stand illustrated in FIG. 2.
Figure 5:
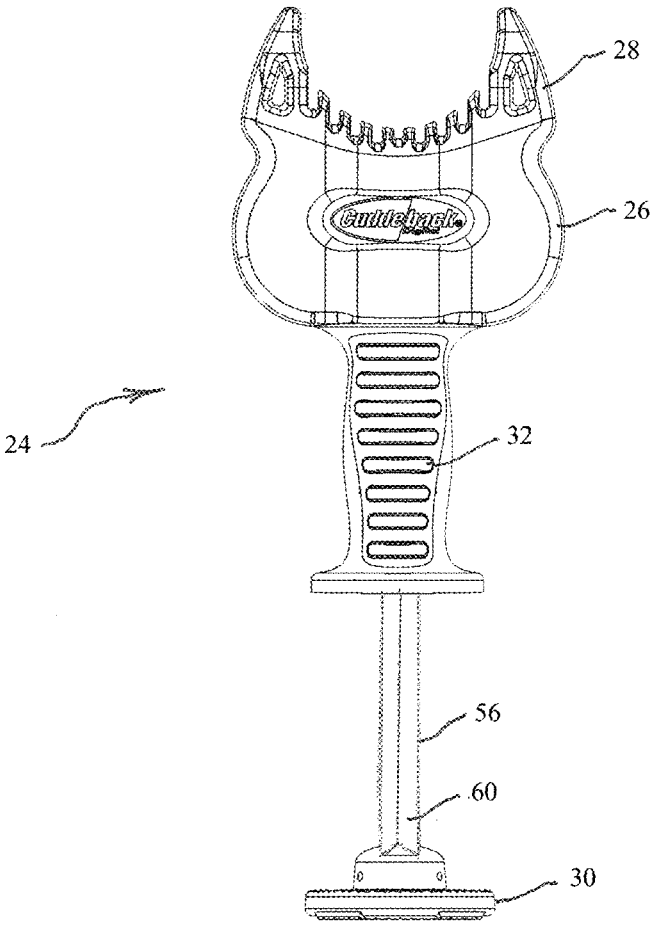
FIG. 5 is a front view of the gun stand illustrated in FIG. 2 with the foot brace in an extended position.
Figure 6:
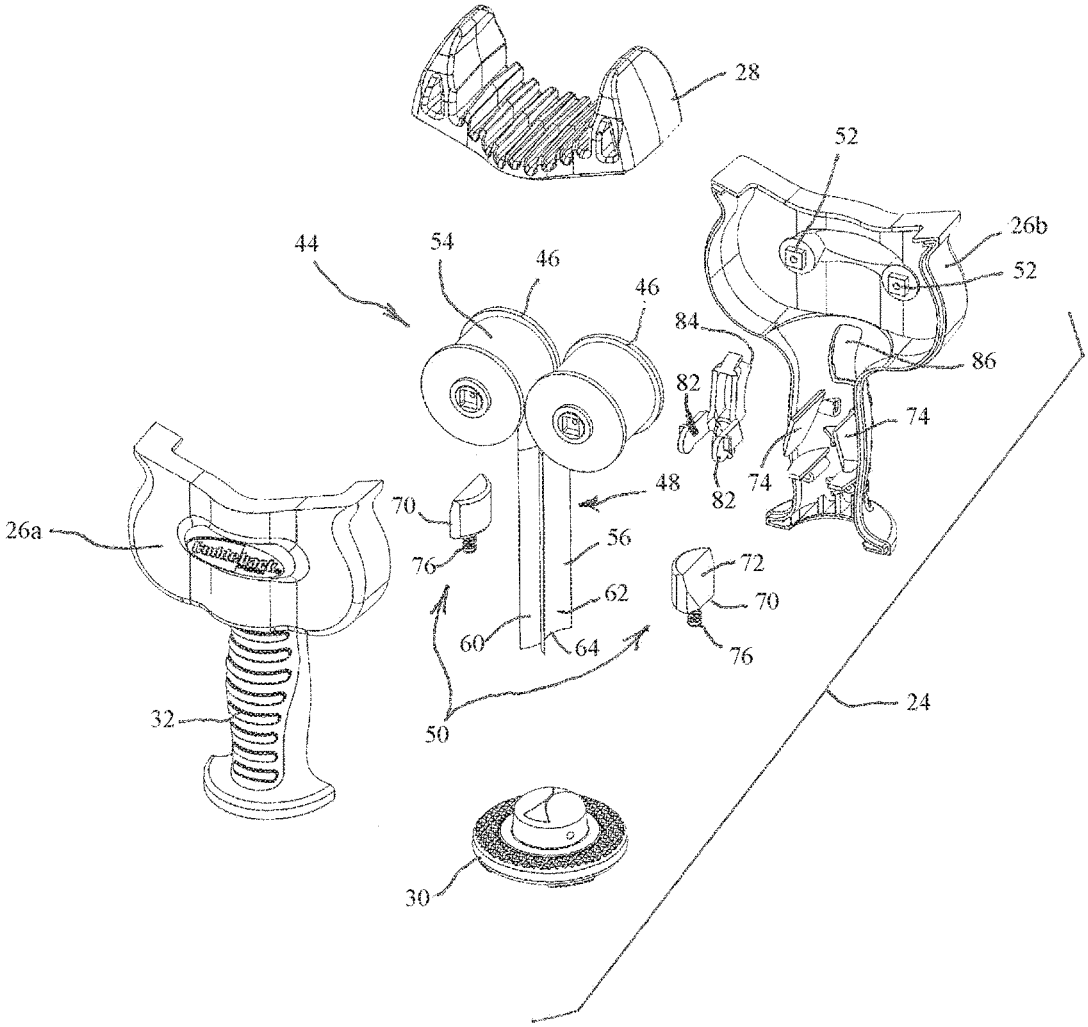
FIG. 6 is an exploded perspective view of the gun stand illustrated in FIG. 2.
Figure 7:
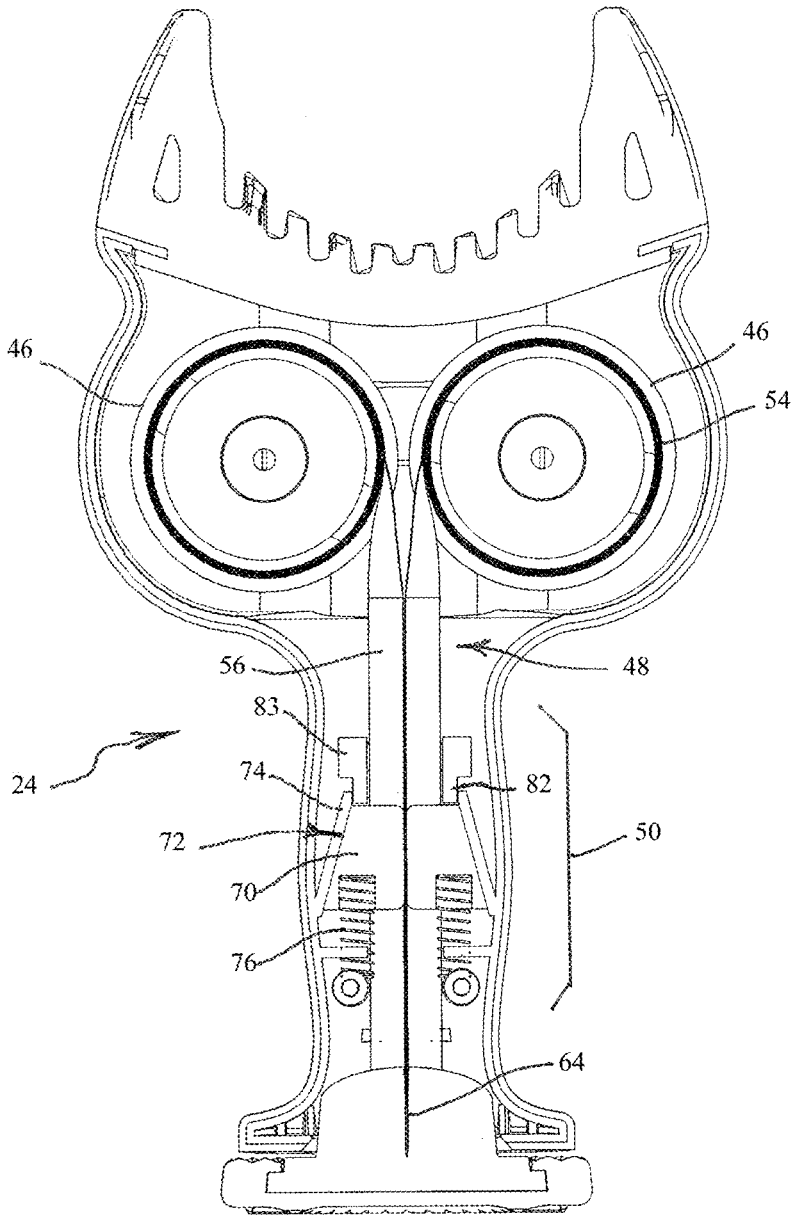
FIG. 7 is a perspective view taken along line 7-7 in FIG. 2.
Figure 8:
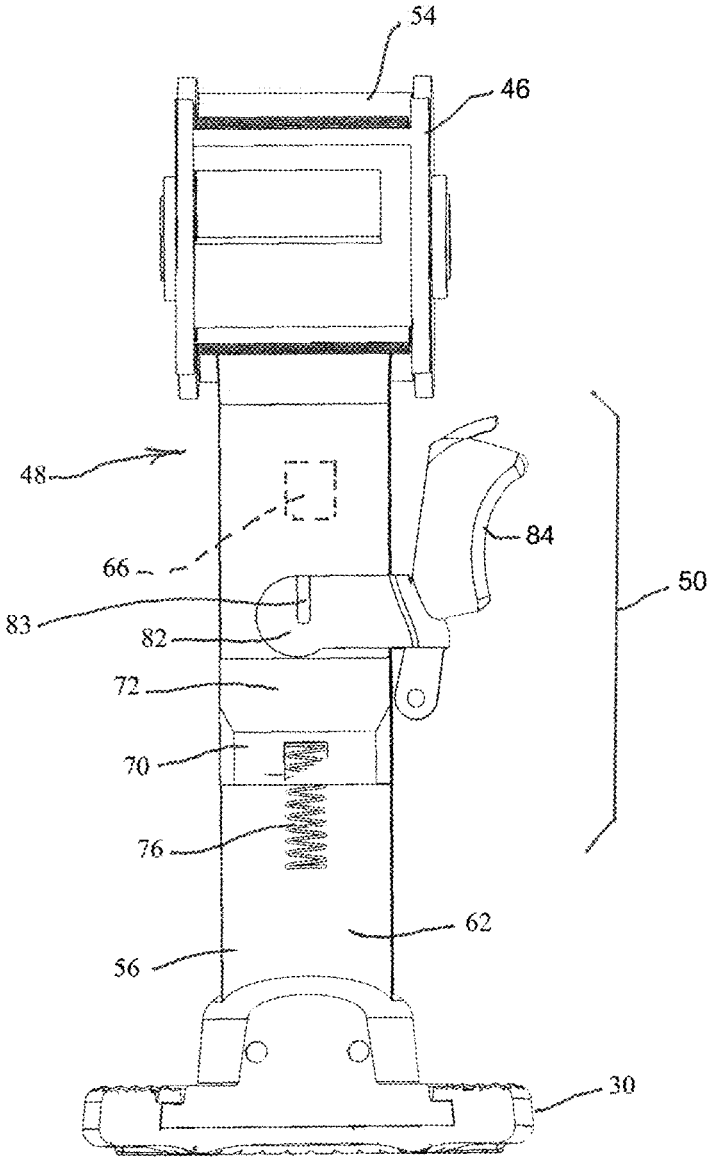
FIG. 8 is a section view taken along line 8-8 in FIG. 2 with a front housing, a rear housing, and an upper support removed for clarity.
Figure 9:
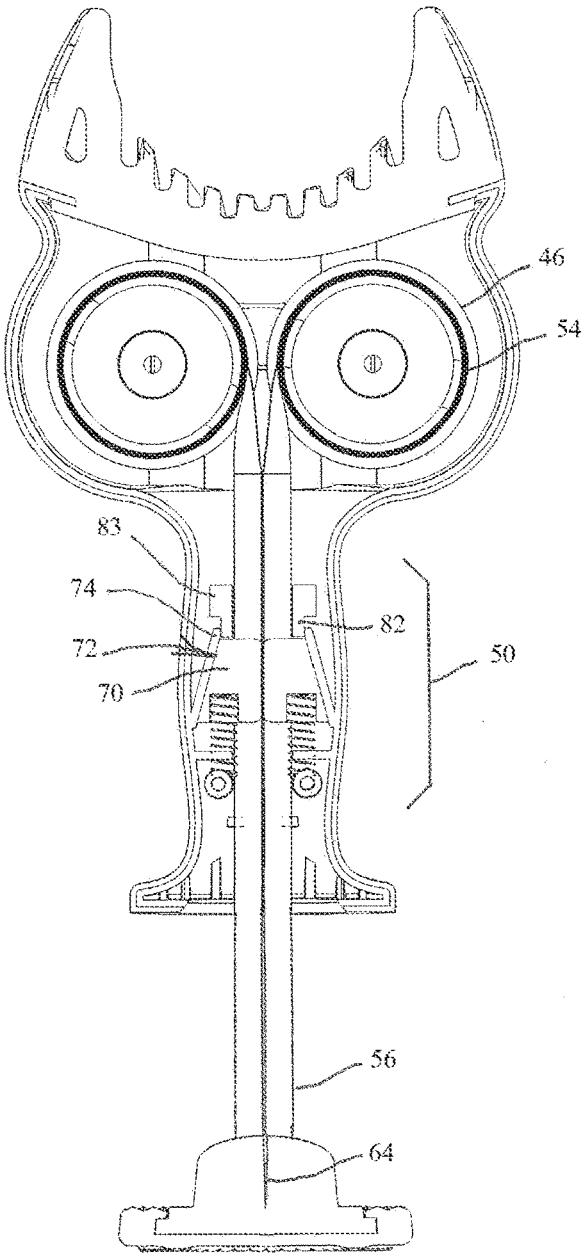
FIG. 9 is the section view of FIG. 7 with the foot brace in the extended position and the locking mechanism in a locked position.

Referring to FIGS. 4-6, the foot brace 30 can be moved relative to the housing 26 from a retracted position (FIG. 4) to an extended position (FIG. 5). This movement is facilitated by a tape spring mechanism 44 (FIG. 6).

Referring to FIGS. 6-10, the tape spring mechanism 44 includes left and right spools 46, left and right ribbons 48 coiled onto the spools, and a locking mechanism 50 that selectively locks and releases the ribbons 48.

Each spool 46 is supported on each end by mounting bosses 52 formed on the inside surface of the housing 26. If desired, each spool 46 can be designed to be rotatable relative to the housing 26 to thereby facilitate winding and unwinding the corresponding ribbon 48. Alternatively, the spool 46 can be rigidly secured in the housing 26, in which case the ribbon 48 will be loosely coiled around the spool 46. Each spool 46 is completely enclosed within the housing 26 and upper support 28.

Each ribbon 48 is a thin-walled ribbon of steel having a coiled portion 54 wrapped onto the corresponding spool 46 and a straight portion 56 extending from the corresponding spool 46. Each straight portion 56 corresponds with a static (non-stressed) condition of the ribbon 48 and has a curved lateral cross-sectional shape defining a convex surface 60 and a concave surface 62. Each coiled portion 54 corresponds with a stressed condition of the ribbon and has a flatter lateral cross-sectional shape. Each ribbon and spool assembly operates on the same principles as a tape measure. In the illustrated embodiment, the convex surface 60 of each straight portion 56 is in a facing orientation relative to the other straight portion 56, although other orientations (e.g., concave surfaces facing each other) are also possible. A free end 64 of each straight portion 56 is secured to the foot brace 30. Due to this arrangement of parts, each ribbon 48 will be uncoiled from the corresponding spool 46 at substantially the same rate as the other ribbon 48.

The illustrated ribbons 48 are arranged to be biased in the coiled direction so that they will automatically wind onto the spools 48 when the locking mechanism 50 is released. For example, if the spools 46 are rotatable, the spools 46 can be biased in a winding direction by a torsion spring. This is advantageous in that it facilitates quick and easy retraction of the ribbons 48 using a single hand. Alternatively, the ribbons 48 can be arranged to be biased in the uncoiled direction so that they will automatically unwind off the spools 48 when the locking mechanism 50 is released. This is advantageous in that it facilitates quick and easy deployment of the foot brace 30 using a single hand when use of the gun stand 24 is desired. This second arrangement further facilitates adjustment of the height of the gun stand 24 without the need to push down on the foot brace 30.

At least one of the ribbons 48 includes a releasable securing mechanism for securing the straight portions 56 of the ribbons 48 to each other. For example, one of the ribbons 48 can be provided with a magnetic material 66 (FIG. 8) embedded into or secured onto the ribbon 48 that will attract the metallic material of the other ribbon 48 to thereby enhance the stability of the gun stand 24. Other releasable securing mechanisms, such as hook and loop fasteners (e.g., Velcro® brand) or zippers could be used instead.

The locking mechanism 50 includes wedge-shaped locking members 70 positioned on opposing sides of each straight portion 56 of the each ribbon 48. Each locking member 70 is movable vertically relative to the housing 26. As each locking member moves upward (toward the upper support 28) relative to the housing 26, a cam surface 72 of the locking member 70 engages an angled guide member 74 on the housing 26 to thereby force the locking member 70 into contact with the corresponding ribbon 48. Because of the alignment of the locking members 70 with each other, any force applied by a locking member 70 on the ribbon 48 is opposed by an opposite force applied by the other locking member 70 on the other ribbon 48. A biasing member in the form of a coil spring 76 biases each locking member 70 in the upward direction into contact with the corresponding guide member 74 and ribbon 48. Absent additional forces on the locking members 70, upward movement of the straight portions 56 of the ribbons 48 is substantially prevented due to the locking members 70 being wedged between the guide members 74 and the ribbons 48. In this regard, the locking members are termed "auto-locking" because they are biased toward a locked position that substantially inhibits upward movement of the ribbons relative to the housing 26. Downward movement of the straight portions 56 of the ribbons 48 is permitted because such movement of the ribbons 48 does not create the wedge effect caused by the locking members 70. As used herein, when referring to the ability to move the ribbons relative to the housing, the terms "permitted"/"unlocked" and "inhibited"/"locked" are relative terms meant to convey that the ribbons are relatively easy to move or not easy to move, respectively. These terms are not meant to require that the ribbons are completely free of restraining forces and immovably locked in place, respectively.

Figure 10:
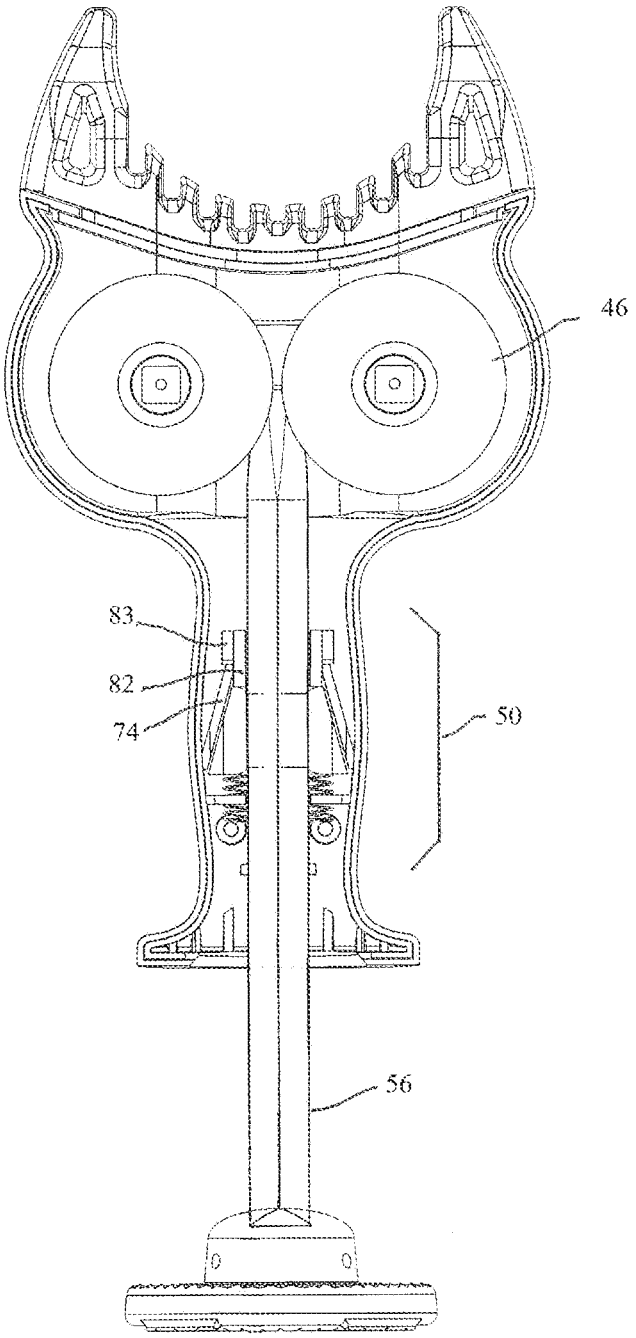
FIG. 10 is the section view of FIG. 9 with the foot brace in the extended position and the locking mechanism it in a released position.

The locking mechanism 50 further includes a release mechanism that releases the locking members 70 and facilitates retraction (upward movement) of the ribbons 48. The release mechanism includes release members 82 that are movable (e.g., pivotable) relative to the housing 26 between a locked position (FIG. 9) and a released position (FIG. 10). In the locked position, the release members 82 are inactive and have no effect on the locking members 70. In the released position, the release members 82 are moved downward into contact with the locking members 70 to thereby move the locking members 70 downward against the biasing force of the springs 76. This downward movement of the locking members 70 prevents the locking members 70 from assuming the wedged position, thereby allowing the ribbons 48 to move upward and coil onto the spools 46. Each release member 82 includes a stop member 83 engageable with the corresponding guide member 74 to limit downward movement of the release members 82.

Movement of the release members 82 between the locked position and the relaxed position is facilitated by a trigger 84 that extends through an opening 86 in the front portion 26*a* of the housing 26. The trigger 84 is formed integrally with the release members 82 such that squeezing of the trigger 84 will cause rotation of the release members 82 from the locked position to the released position.

Figure 11:
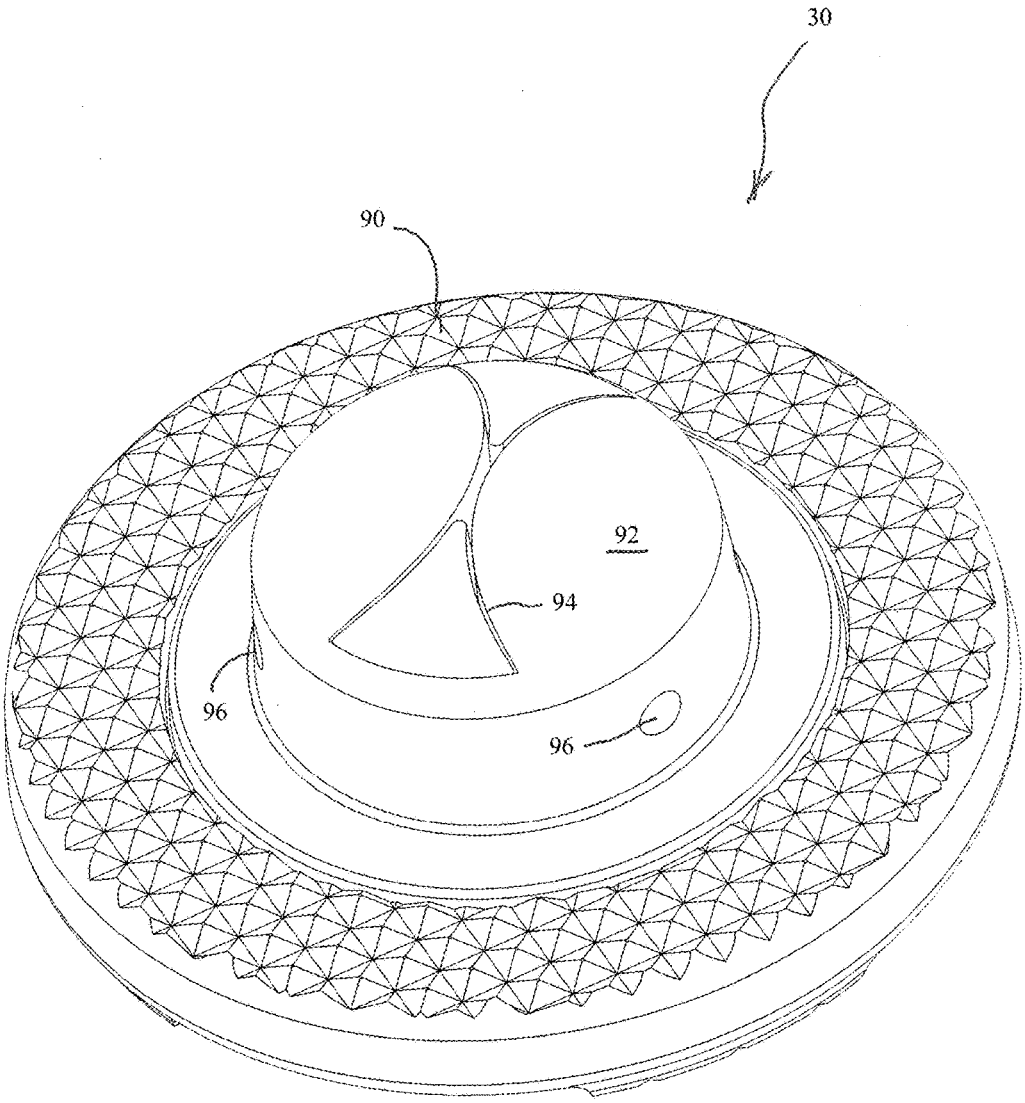
FIG. 11 is an enlarged perspective view of the foot brace.
Figure 12:
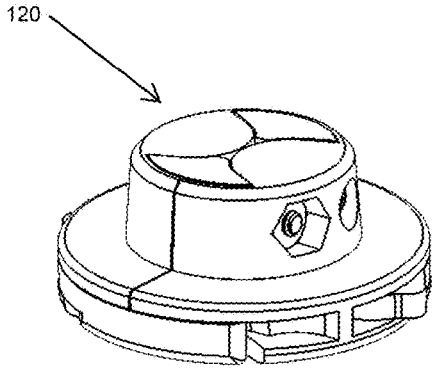
FIGS. 12-13 are perspective views of a foot brace of a second embodiment of the present invention in a retracted position.
Figure 13:
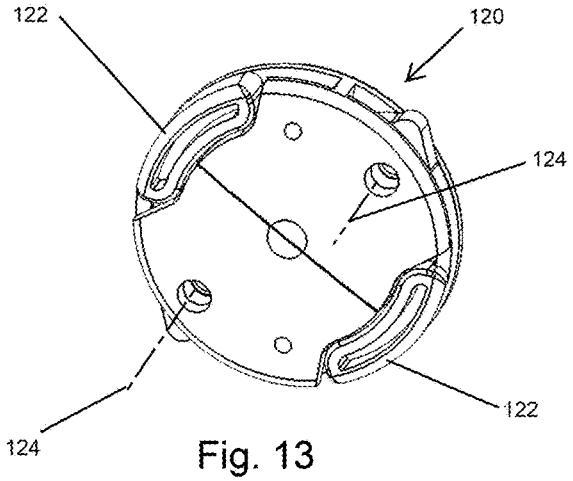

Referring to FIG. 11, the illustrated foot brace 30 is a disc-shaped member having an engagement surface 90 that is roughened (e.g., knurled) to increase the frictional engagement of a users boot with the foot brace 30. The foot brace 30 includes a center portion 92 that is raised and includes two arcuate-shaped slots 94 extending longitudinally into the upper surface of the center portion 92. Each slot 94 is shaped to receive the free end 64 of one of the ribbons 48. Each side of the center portion 92 includes to openings 96 that are dimensioned to receive fasteners (e.g., setscrews, bolts, pins, or other suitable fastener) for securing the foot brace 30 to the ribbons 48.

In operation, use of the gun stand 24 is initiated by pulling the foot brace 30 downward relative to the housing 26, thereby causing the ribbons 48 to be uncoiled from the spools 46. If desired, the trigger 84 can be pressed to decrease the effort required to move the foot brace 30. The foot brace 30 is then contacted the ground, and the users foot is placed on the engagement surface 90 to hold the foot brace 30 in engagement with the ground. The height of the upper support 28 can then be adjusted (with or without the gun 20 resting in the upper support 28) by moving the housing 26 upward (with or without the trigger 84 pressed) or downward (while pressing the trigger 84). When the desired height is achieved, the trigger 84 is released. When it is desired to collapse the gun stand 24, the trigger 84 is pressed, thereby causing the ribbons 48 to retract into the housing 26 and causing the foot brace 30 to move toward the housing 26 and into the retracted position.

An alternative configuration for the foot brace is illustrated in FIG. 1. The alternative foot brace 100 includes a base 102 and a folding arm 104 that can be pivoted relative to the base 102 from and unfolded position (as illustrated in FIG. 1) to a folded position. In the folded position, each arm 104 is substantially aligned with and resides within a cavity 106 defined by the curved shape of one of the ribbons 108. This folded position of the arms 104 facilitates retraction of the foot brace 100 into the housing 110 by allowing the folded arms 104 to fit inside the lower opening of the housing 110 through which the ribbons 108 extend.

The gun stand 22 illustrated in FIG. 1 further includes a securing mechanism in the form of an adjustable strap 112 that secures the gun stand 22 to the gun 20. The strap 112 wraps over the top of the gun 20 and is secured to both sides of the housing 110. At least one end of the strap 112 includes multiple openings 114 for adjusting the effective length of the strap 112. Preferably, the strap 112 is made from a resilient material that can be tensioned when it is securing the gun 20 to the gun stand 22. Such a securing mechanism inhibits movement of the gun 20 relative to the gun stand 22, and further allows the gun stand 22 to stay attached to the gun 20 when the foot brace 100 is in the retracted position (e.g., when the gun 20 is not being operated). Such an arrangement facilitates quick and easy deployment of the gun stand 22.

Figure 14:
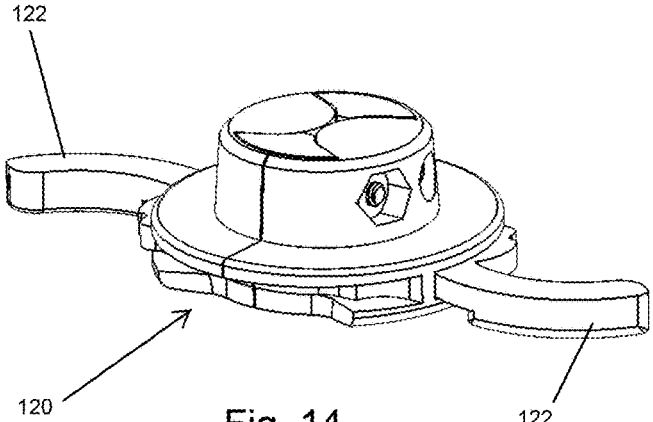
FIGS. 14-15 are perspective view of the foot brace of FIGS. 12-13 in an extended position.
Figure 15:
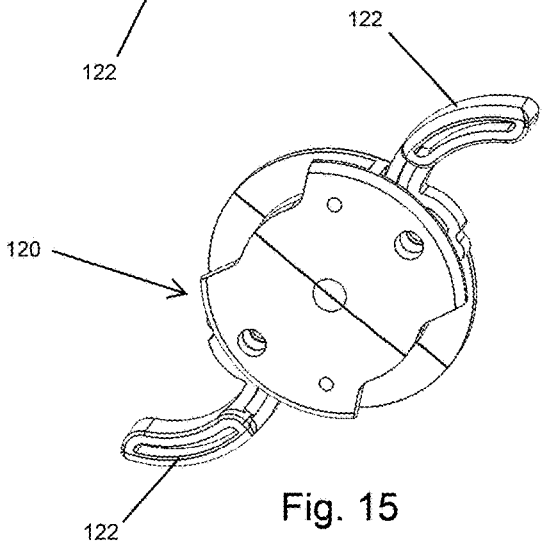
Figure 16:
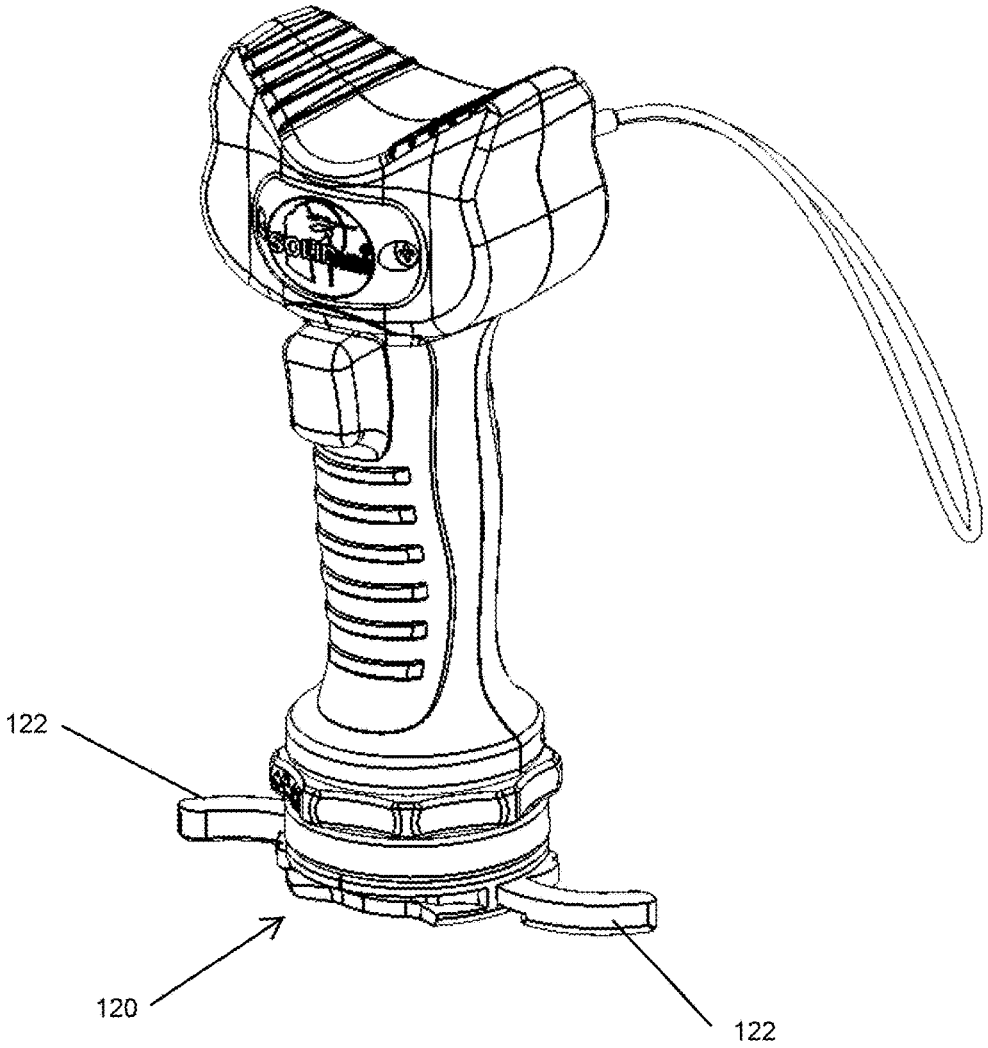
FIG. 16 is a full perspective view of a gun stand that is the second embodiment of the present invention.

FIGS. 12-16 illustrate an alternate foot brace 120 that can be used in connection with a second embodiment of the present invention. The foot brace 120 includes two pivoting arms 122 that can be rotated about pivot axes 124 from a retracted position (FIGS. 12-13) to an extended position (FIGS. 14-16). In the retracted position, the foot brace provides a compact unit that is easier to fit into and carry in a pack. In the extended position, the arms can be held against the ground (or other supporting surface) by the user's foot to provide a stable support for the gun stand.

Figure 17:
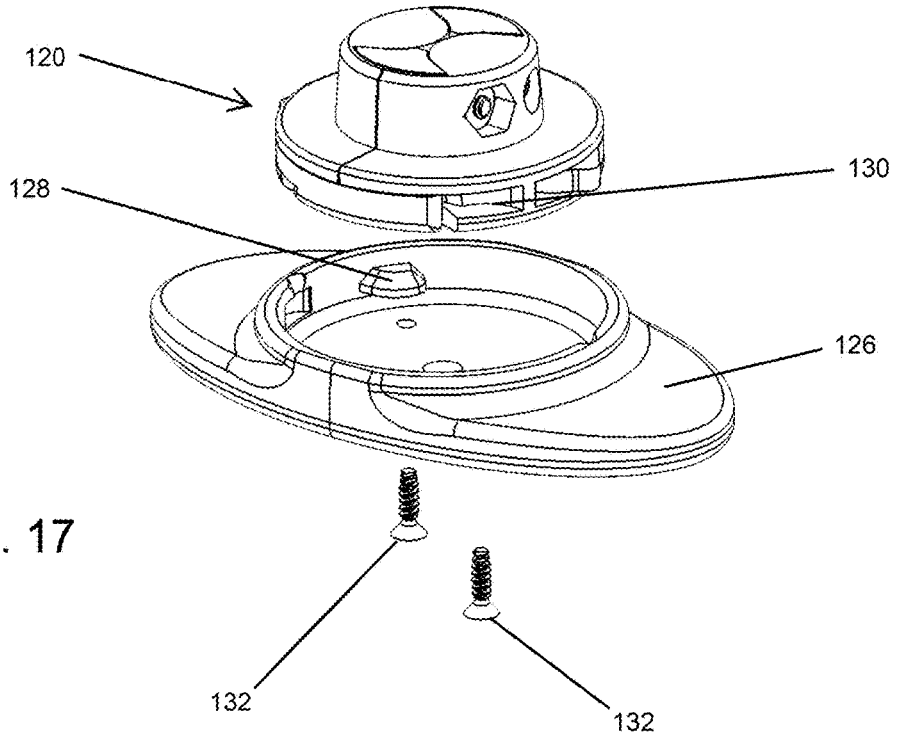
FIG. 17 shown a foot pad that can be added to the gun stand of FIG. 16.
Figure 18:
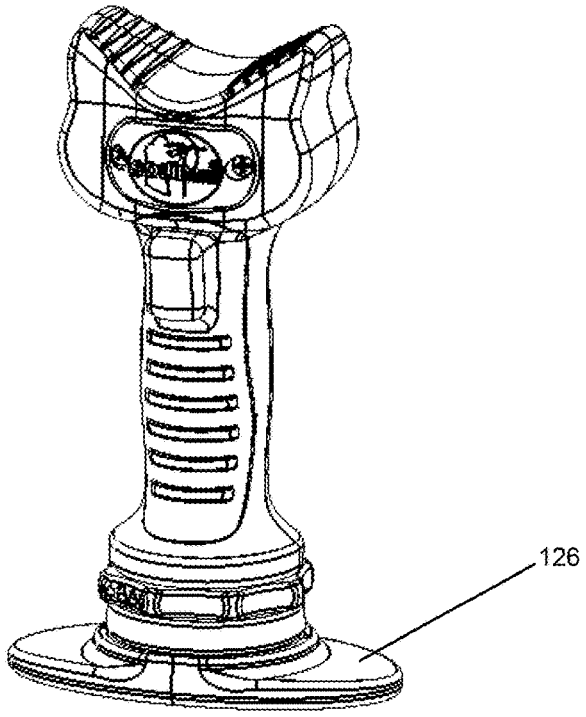
FIG. 18 shows the gun stand of FIG. 16 with the foot pad of FIG. 17 installed.
Figure 19:
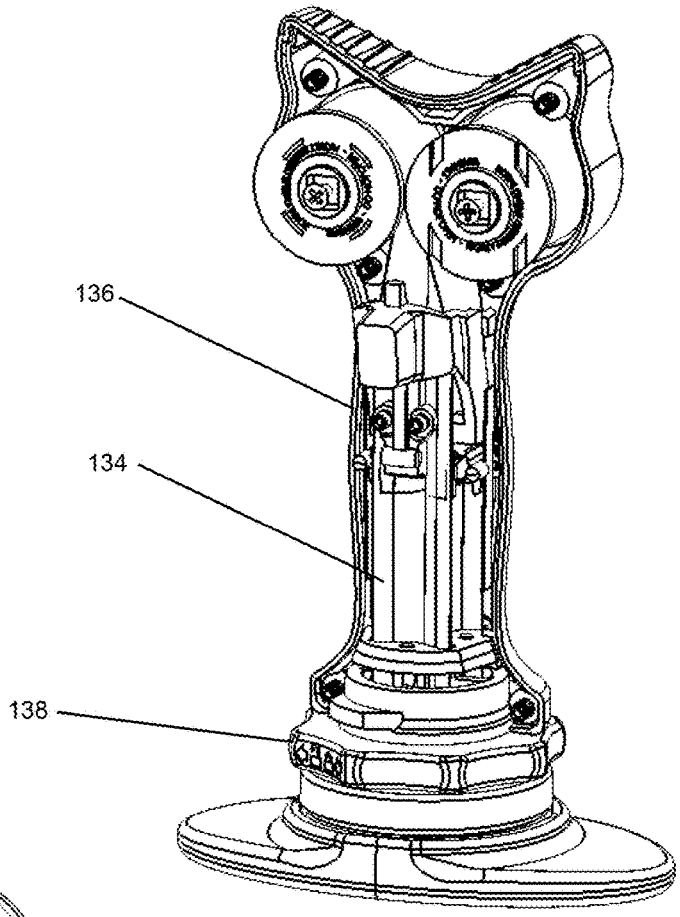
FIG. 19 shows the gun stand of FIG. 18 with the front cover removed and showing a manual locking mechanism.
Figure 20:
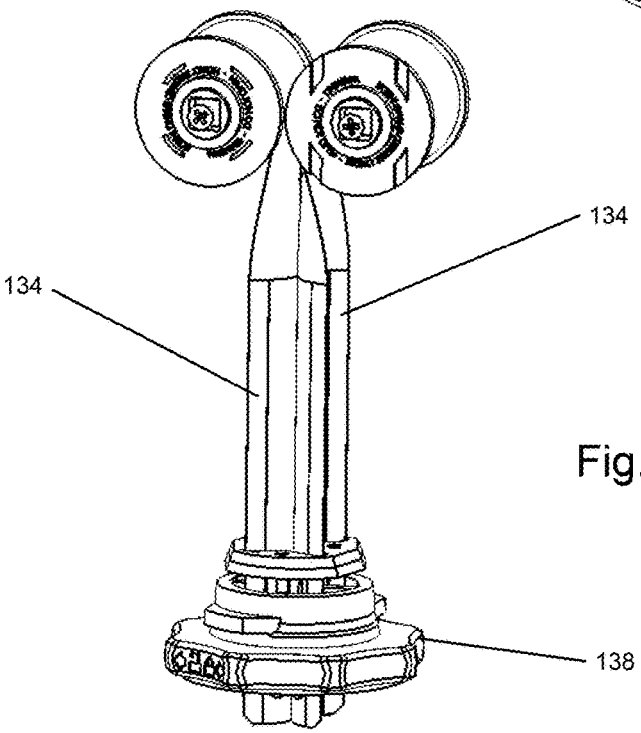
FIG. 20 is a perspective view of the manual locking mechanism shown with two ribbons.
Figure 21:
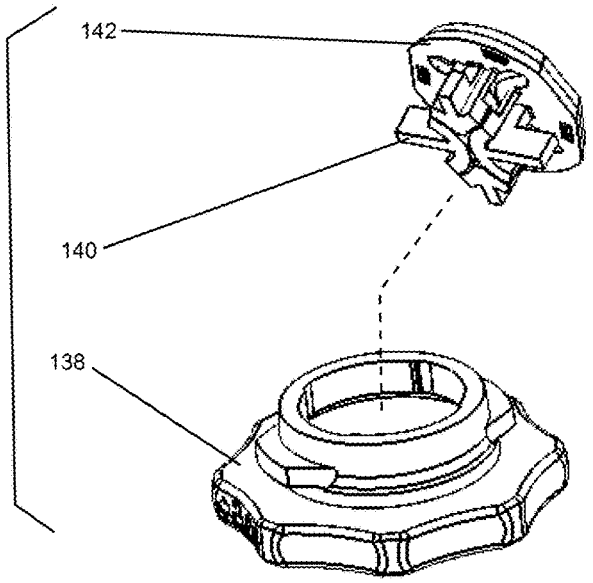
FIG. 21 is an exploded perspective view of the manual locking mechanism.

FIGS. 17-18 illustrate an optional footpad 126 that can be attached to the foot brace 120. The footpad 126 is preferably made from a softer, resilient material, such as polyurethane or rubber, and provides a larger surface area for supporting the gun stand. This is particularly advantageous when supporting the gun stand in a tree stand made in a grate pattern. The footpad 126 includes opposing detent members 128 adapted to fit into recesses 130 in the foot brace 120, thereby securing the foot pad 126 to the foot brace 120 while allowing the footpad 126 to be attached and detached without the use of tools. Alternatively, fasteners 132 can be used to secure the footpad 126 to the foot brace 120.

FIGS. 19-22 illustrate a manual locking mechanism movable between unlocked and locked positions to selectively secure the position of the ribbon 134 relative to the housing 136. Although the ribbons are not shown in FIG. 22, the ribbon paths 137 are seen as back-to-back arcs. The manual locking mechanism includes a cam lock actuator 138 mounted on the housing for rotation between the unlocked and locked positions. The manual locking mechanism further includes four manual locking members 140 movable by the cam lock actuator 138 between the unlocked and locked positions. The manual locking members 140 are each mounted in a cantilevered fashion on a support plate 142 that is secured to the housing 136. The cantilevers mounting facilitates movement of the manual locking members 140 toward and away from each other to selectively pinch (and lock) the ribbon paths 137.

Figure 22:
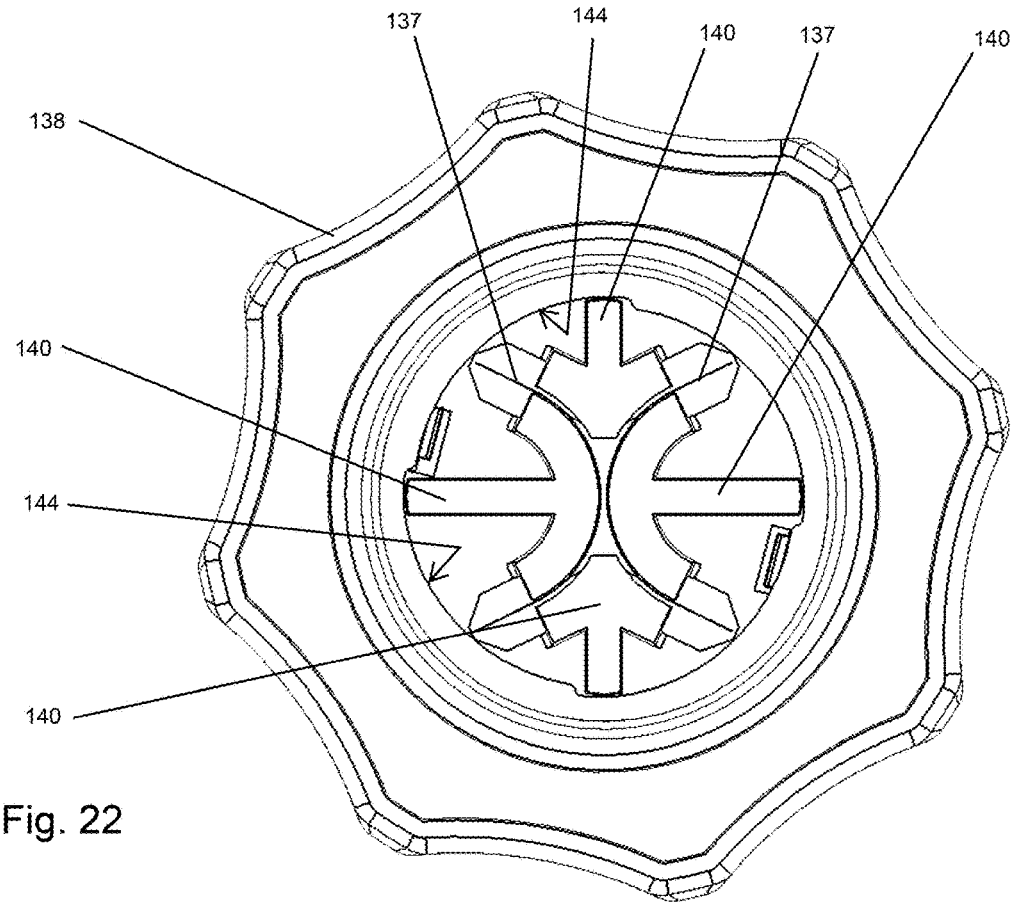
FIG. 22 is an enlarged bottom view of the manual locking mechanism.

The cam lock actuator includes four cam surfaces 144 that each engages a corresponding manual locking member 140 and provides movement to the locking member from the unlocked position (away from each other) to the locked position (toward each other). FIG. 22 shows the cam lock actuator 138 in the unlocked position with the four cam surfaces 144 each engaged with a corresponding manual locking member 140. By manually rotating the cam lock actuator 138 in the clockwise direction (as shown in FIG. 22), it can be seen that the cam surfaces 144 will push the manual locking members 140 toward each other to pinch the ribbon paths 137.

The above-described manual locking mechanism can be used to lock the position of the ribbons 134 relative to the housing 136, thus inhibiting the chance that the ribbons 134 will slip (e.g., if the trigger 84 is accidentally pressed). Manual locking is accomplished by rotating the cam lock actuator 138 about ¼ turn relative to the housing 136. Manual unlocking is accomplished by reversing the rotation of the cam lock actuator 138.

Thus, the invention provides, among other things, a gun stand that is compact, lightweight, retractable, and can be easily deployed in the field. It should be understood that the above described stand can be used to support rifles, pistols, still cameras, video cameras, cross bows, or other similar devices. Various features and advantages of the invention are set forth in the following claims.

The invention claimed is:

1. A retractable stand comprising: a base adapted to support a device;

two ribbons, each having a coiled portion and an uncoiled portion, wherein the uncoiled portions of the ribbons have a curved cross-sectional shape and are positioned in opposing relation to each other;

a brace secured to free ends of the uncoiled portions of the ribbons such that the uncoiled portions of the ribbons support the base on the brace without additional structural support below the base; and a locking mechanism mounted on the base and movable between an unlocked position where at least one ribbon is substantially permitted to move relative to the base and a locked position where the at least one ribbon is substantially inhibited from moving relative to the base in at least one direction.

2. A retractable stand as claimed in claim 1, wherein the base comprises a housing that substantially entirely encloses the coiled portions of the two ribbons.

3. A retractable stand as claimed in claim 1, wherein the curved cross-sectional shape of each uncoiled portion defines a convex surface and a concave surface, and wherein the convex surfaces of the uncoiled portions of the ribbons are in facing relation to each other.

4. A retractable stand as claimed in claim 1, wherein the locking mechanism comprises a cam lock actuator.

5. A retractable stand as claimed in claim 1, wherein the locked position substantially inhibits movement of the at least ribbon into the base but does not substantially inhibit movement of the at least one ribbon out of the base.

6. A retractable stand as claimed in claim 1, wherein the locking mechanism comprises a biased locking mechanism having an auto-locking member biased toward the locked position.

7. A retractable stand as claimed in claim 6, wherein the locking mechanism further comprises a trigger mounted on the base and accessible by the user to move the auto-locking member to the unlocked position.

8. A retractable stand as claimed in claim 7, wherein the retractable stand further includes a manual locking mechanism that can be manually selectively moved between unlocked and locked positions to selectively lock and unlock a position of at least one of the ribbons relative to the base.

9. A retractable stand as claimed in claim 8, wherein the manual locking mechanism includes at least two manual locking members.

10. A retractable stand as claimed in claim 9, wherein both of the manual locking members are biased toward an unlocked position.

11. A method of using a retractable stand having a base, two ribbons each having a coiled portion positioned in the base and an uncoiled portion extending from the base wherein the uncoiled portions of the ribbons have a curved cross-sectional shape and are positioned in opposing relation to each other, and a locking mechanism mounted on the base, the method comprising:

moving a free end of the uncoiled portions of the ribbons away from the base to thereby uncoil a portion of the ribbons, wherein the free end includes a foot brace, and wherein moving the free end includes placing a user's foot on the foot brace;

supporting the free end on a supporting surface below the base;

substantially inhibiting movement of the free end toward the base using the locking mechanism;

holding the base above the supporting surface; and positioning a device on the base.

12. A method as claimed in claim 11, wherein the locking mechanism includes a cam lock actuator, and wherein substantially inhibiting includes moving the cam lock actuator from an unlocked position to a locked position.

13. A method as claimed in claim 11, wherein substantially inhibiting includes substantially permitting movement of the free end away from the base.

14. A method as claimed in claim 11, further comprising retracting the free end toward the base until the uncoiled portions of the ribbons are completely housed within the base.

15. A method as claimed in claim 14, wherein the locking mechanism includes an auto-locking member biased toward a locked position and a trigger mounted on the base and accessible by the user to move the locking member from the locked position to an unlocked position, and wherein retracting comprises moving the trigger.

16. A method as claimed in claim 15, wherein the retractable stand further includes a manual locking mechanism that is manually movable between unlocked and locked positions to selectively lock and unlock a position of at least one of the ribbons relative to the base, and wherein the method further includes, after the moving step and before the retracting step, the step of manually moving the manual locking mechanism to the locked position.

17. A method as claimed in claim 11, wherein the devices comprises a rifle, a pistol, a still camera, a video camera, or a cross bow.

18. A retractable stand comprising:

a base adapted to support a device;

first and second ribbons, each having a coiled portion and an uncoiled portion, wherein the uncoiled portions of the ribbons have a curved cross-sectional shape and are positioned in opposing relation to each other; and a locking mechanism mounted on the base and movable between an unlocked position where the first ribbon is substantially permitted to move relative to the base and a locked position engaging the first ribbon to substantially inhibited the first ribbon from moving relative to the base in at least one direction.

19. A retractable stand as claimed in claim 18, wherein the curved cross-sectional shape of each ribbon defines a concave surface, and wherein the locking mechanism includes a first locking member having a convex surface engageable with the concave surface of the first ribbon when the locking mechanism is in the locked position.

20. A retractable stand as claims in claim 19, wherein the locking mechanism further includes a second locking member having a convex surface engageable with the concave surface of the second ribbon when the locking mechanism is in the locked position.

* * * * *